US007866178B2

(12) United States Patent
Kung

(10) Patent No.: US 7,866,178 B2
(45) Date of Patent: Jan. 11, 2011

(54) DEVICE AND METHOD FOR VACUUM-SEALING A COOLING MEDIUM

(75) Inventor: Hsin-Wen Kung, Kaohsiung (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 782 days.

(21) Appl. No.: 11/781,960

(22) Filed: Jul. 24, 2007

(65) Prior Publication Data

US 2009/0025415 A1 Jan. 29, 2009

(51) Int. Cl.
*F25B 19/00* (2006.01)

(52) U.S. Cl. ..... 62/268; 62/270

(58) Field of Classification Search ..... 62/100, 62/169, 268, 170, 270, 259.2; 165/104.32, 165/104.33

See application file for complete search history.

(56) References Cited

U.S. PATENT DOCUMENTS 2,851,582 A * 9/1958 Meyers et al. ..... 219/85.17
2,891,807 A * 6/1959 Auwarter ..... 285/41
2,937,437 A * 5/1960 Cole et al. ..... 29/424
3,110,793 A * 11/1963 Worthington ..... 219/615
3,121,630 A * 2/1964 Bussard ..... 419/60
3,228,073 A * 1/1966 Harrison et al. ..... 164/70.1
3,447,910 A * 6/1969 Sporrer ..... 117/203
4,296,347 A * 10/1981 Weirauch ..... 310/313 B
4,712,379 A * 12/1987 Adams et al. ..... 60/632
5,232,641 A * 8/1993 Williamson et al. ..... 264/40.6
5,375,431 A * 12/1994 Later et al. ..... 62/268
5,514,309 A * 5/1996 Williamson et al. ..... 264/37.17
6,090,422 A * 7/2000 Taragan et al. ..... 426/231

* cited by examiner

*Primary Examiner*—Mohammad M Ali

(57) ABSTRACT

A device and a method for vacuum-sealing cooling medium is to allow a work piece being vacuumed for the cooling medium being introduced into the work piece. The device provides a first passage, a second passage, a sucking unit, a cooling medium supply unit and a sealing passage. The first passage and the second passage each have an end being connected to the sucking unit and the cooling medium supply unit respectively. The sealing passage communicates with another end of the first passage and another end of the second passage respectively and provides a sealing component, wherein a conveying passage is provided at the sealing component for the work piece being vacuumed or introduced with the cooling medium via said first passage or said second passage.

6 Claims, 6 Drawing Sheets

DEVICE AND METHOD FOR VACUUM-SEALING A COOLING MEDIUM

BACKGROUND OF THE INVENTION

1. Field of the Invention

The present invention is related to a device and a method for vacuum-sealing a cooling medium and particularly to a device with which a work piece is capable of being vacuumed and filled with the cooling medium during a heat dissipation system containing the cooling medium being worked.

2. Brief Description of the Related Art

The electronic equipment such as the main unit of a computer, the liquid crystal display, the plasma television and etc. usually provide a cooling system. In order to obtain better effect of heat dissipation and maintain the electronic equipment being steady in operation, the water cooling type heat dissipation system is widely adopted due to no other types of the heat dissipation system providing the same feature as the water cooling type heat dissipation system has.

Taiwan Utility Model Publication No. M311235, entitled "WATER COOLED HEAT DISSIPATION DEVICE", discloses a metal base disposed on top of a high heat generating unit and a guide pipe extends from the metal base to connect with a heat sink. Cooling liquid is filled in the guide pipe to flow between the metal cooling base and the guide pipe. When the high heat unit is in operation, the heat can be transmitted to the cooling liquid. The cooling liquid, which absorbs the heat and passes through the heat sink to reduce temperature thereof, can flow back to the metal cooling base for achieving purpose of heat dissipation.

Taiwan Patent Publication No. 1276385 entitled "Extremely fast heat dissipation device" is disclosed to introduce gas with vacuum instead of liquid. However, the prior art in spite of introducing liquid or gas is hard to fabrication and provides strict criteria of design.

SUMMARY OF THE INVENTION

In order to overcome the preceding prior art requiring high fabrication and more difficult technique, a main object of the present invention is to provide a device for vacuum-sealing cooling medium in which a first passage and a second passage are provided to be joined to a sucking unit and a cooling medium supply unit with an end thereof respectively and to extend to be joined to a sealing passage with another end thereof respectively and a sealing component with a conveying passage is provided in the sealing passage.

Another object of the present invention is to provide a method for vacuum-sealing cooling medium, which includes following steps: (a) a device for vacuum-sealing cooling medium being attached to a work piece and a sealing component blocking a first passage and a second passage provided in the device; (b) a conveying passage provided in the sealing component being joined to the first passage, the work piece being vacuumed and the operation of the work piece being vacuumed being paused; (c) the conveying passage being joined to said second passage, cooling medium being introduced into the work piece and then operation of the cooling medium being introducing into the work piece being paused; and (d) the sealing component being inserted into the work piece to seal the work piece.

A further object of the present invention is to provide a device for vacuum-sealing cooling medium capable of reducing fabrication cost in which a sealing component with a conveying passage is capable of allowing the work piece being vacuumed and the cooling medium being introduced into the work piece via the first passage or the second passage provided in the sealing passage and can be inserted into the work piece for sealing the work piece.

A further object of the present invention is to provide a method for vacuum-sealing liquid or gas, which includes following steps: (a) a device for vacuum-sealing cooling medium being attached to a work piece and a sealing component blocking a first passage and a second passage provided in the device; (b) a conveying passage provided in the sealing component being joined to the first passage, the cooling medium being introduced into the work piece and then the operation of the work piece being introduced with cooling medium being paused; (c) the conveying passage being joined to said second passage, the work piece being vacuumed and then operation of vacuum being paused; and (d) the sealing component being inserted into the work piece to seal the work piece.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
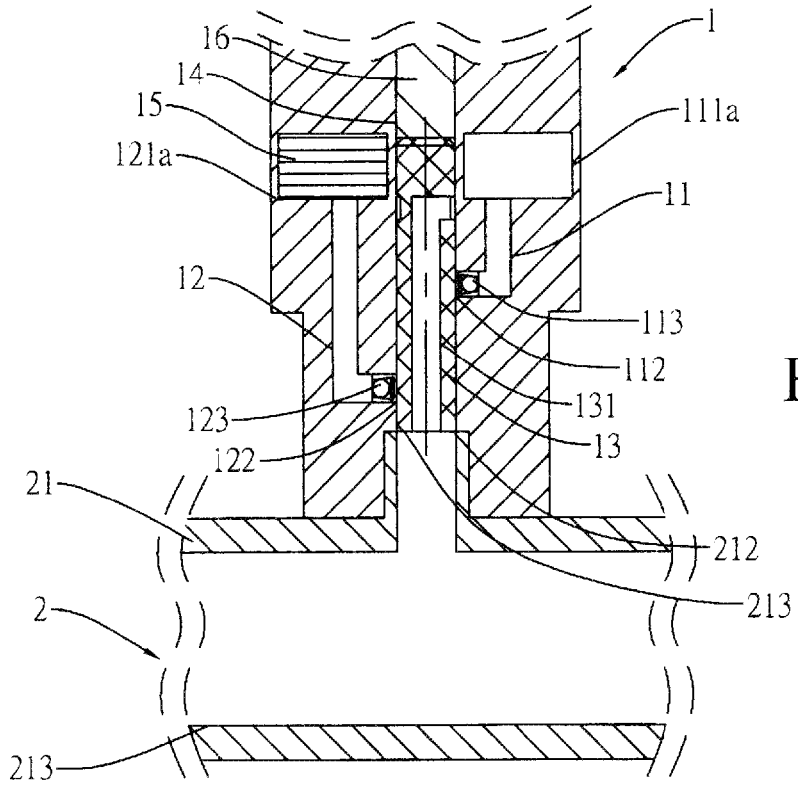
FIG. 1 is a sectional view of the first preferred embodiment of a device capable of vacuum-sealing a cooling medium according to the present invention illustrating the sealing member being disposed at a position in the sealing passage ready for working.

Referring to FIGS. 1 to 5, the first embodiment according to the present invention provides a device 1, which is capable of vacuum-sealing a cooling medium and the device 1 has a first passage 11, a second passage 12 and a sealing passage 14. The first passage 11 and the second passage 12 have an end thereof connecting with a sucking unit 111*a* and a cooling medium supply unit 121*a* respectively and have another end thereof extending to communicate with the sealing passage 14.

The work piece 2 has a chamber 21 with an opening 211 and the opening 211 is provided with a sealing ring 212 for the joint at the device 1 and the opening 211 being sealed completely such that it is capable of preventing the cooling medium 15 from leaking outward. The chamber 21 provides a receiving room 213 to receive the cooling medium 15 while gas in the receiving room 213 is sucked out with the device 1 and the receiving room 213 is in a state of vacuum.

The sucking unit 111*a* is employed to suck the gas in the receiving room 213 out and allow the inner side of the work piece 2 being in a state of vacuum. The cooling medium 15 contained in the supply unit 121*a* can be in any forms and can guide heat swiftly to attain excellent cooling effect. Hence, the cooling medium 15 used here is liquid or gas.

The sealing passage 14 provides a sealing component 13, which is capable of sliding in the sealing passage 14 due to the device 1 providing a driving unit 16 such as a push lever or a piston to press against the sealing component 13. The sealing component 13 has a conveying passage 131, which is changeable in direction, such that the device 1 can vacuum the work piece 2 or introduce the cooling medium 15 into the work piece 2 via either the first passage 11 or the second passage 12.

FIG. 1 illustrates the sealing component 13 being disposed in the sealing passage 14 in a state of being ready for work. Right at the time, the sealing component 13 slides to a position to block the first passage 11 and the second passage 12 such that the first gate port 112 of the first passage 11 and the second gate port 122 of the second gate port 122 are obstructed by the sealing component 13 and a common space between the sealing passage 14 and receiving room 213 keeps being closed for subsequent vacuum operation being performed successfully.

Figure 2:
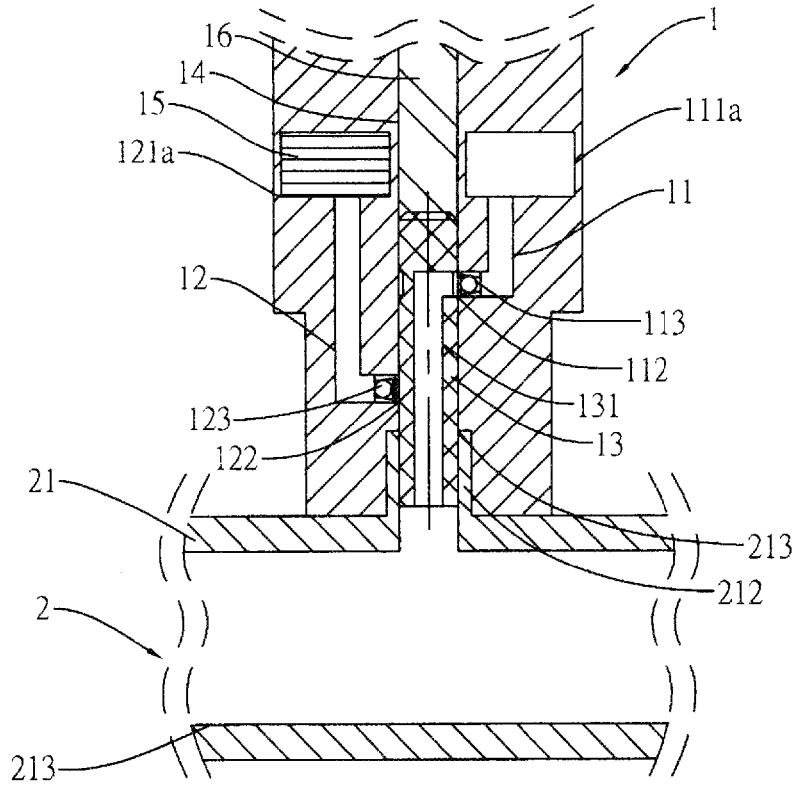
FIG. 2 is a sectional view similar to FIG. 1 illustrating the sealing member being disposed at a position in the sealing passage and in a state of vacuum suction.

FIG. 2 illustrates the device 1 being in a state of vacuum. The sucking unit 111*a* is in operation and the sealing component 13 slides to another position to open the first passage 11 although the second passage 12 is still in a state of being blocked such that the first passage 117 the conveying passage 131 and the common space between sealing passage 14 and the receiving room 213 communicates with each other. In this way, the sucking unit 111*a* is capable of performing vacuum operation for the receiving room 213.

A constant vacuum pressure can be maintained during the vacuum operation so that the work piece 2 is incapable of being deformed in spite of the gas pressure in the receiving room 213 is less than the atmosphere. Once the work piece 2 is in a state of vacuum, vacuum operation is paused by means of turning off the sucking unit 111*a*, another sealing component being provided on top of the present sealing component to block the first passage 11 or the first gate port 112 providing a check valve 113.

Figure 3:
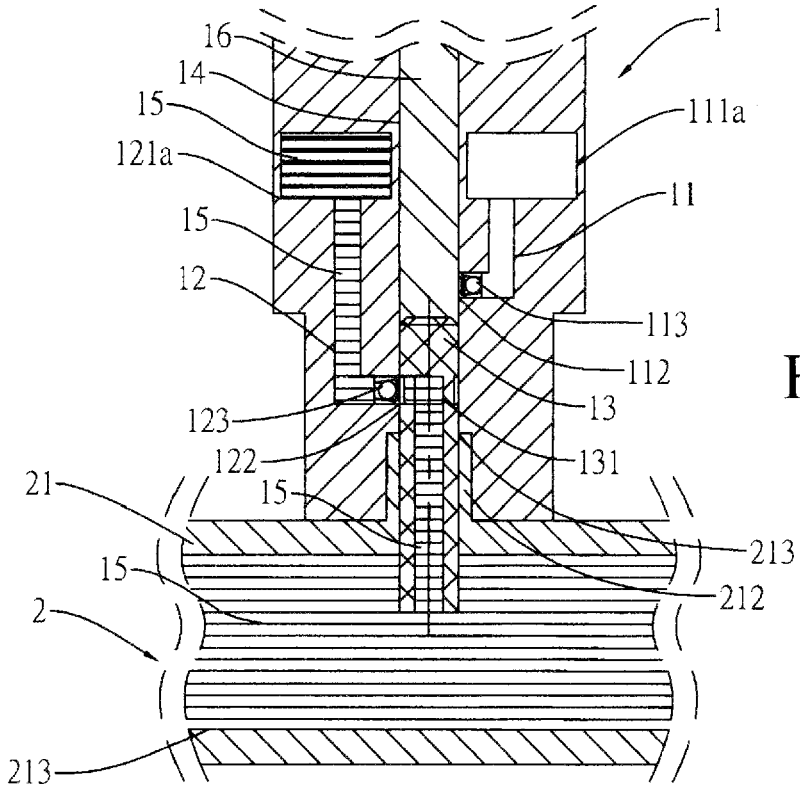
FIG. 3 is a sectional view similar to FIG. 2 illustrating a state of the cooling medium being introduced into the device of the present invention.

FIG. 3 illustrates the device 1 being in a state of introducing the cooling medium. The cooling medium supply unit 121*a* starts operation and the sealing component 13 slides to a further position to open the second passage 12 although first gate port 112 is blocked. Under this circumference, the second passage 12, the conveying passage 131 and the common space between the sealing passage 14 and the receiving room 213 are closed. Meanwhile, the second gate port 122 communicates with the conveying passage 131 and the cooling medium 15 is introduced into the receiving room 231 during the cooling medium supply unit 121*a* in operation. Once the cooling medium 15 being filled in the receiving room 213 is completed, the operation of the cooling medium supply unit 121*a* is paused by means of another sealing component being provided on top of the sealing component 13 to block the second passage 12 or another check 123 being provided at the second gate port 122.

Figure 4:
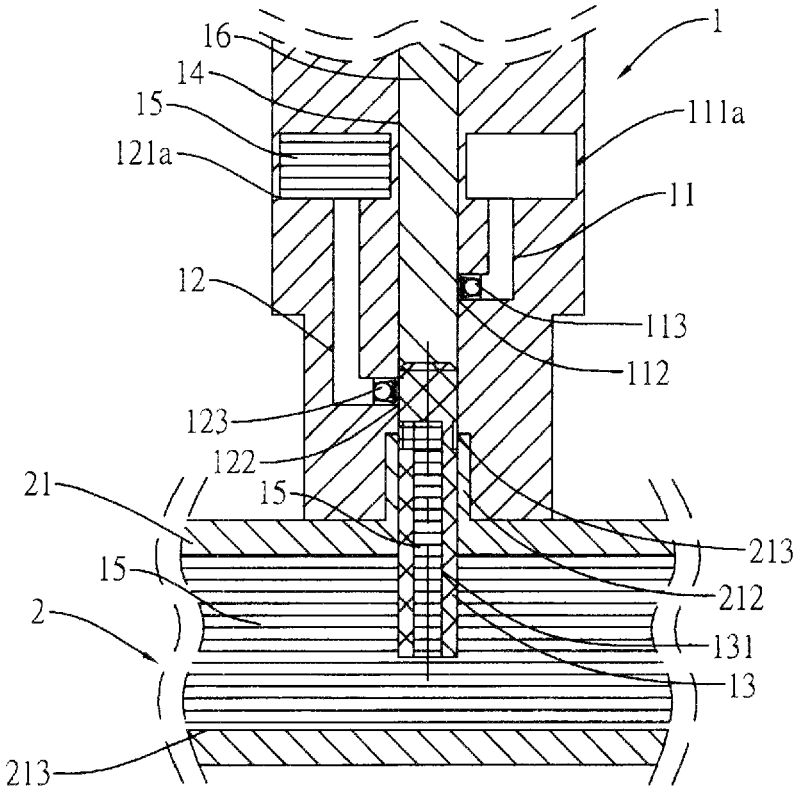
FIG. 4 is a sectional view similar to FIG. 3 illustrating the device of present invention being in a closed state.

FIG. 4 illustrates the device 1 being in a state of closing. The sealing component 13 passes over a position between the device 1 and the sealing ring 212 of the work piece 2 to block the conveying passage 131 such that the common space between the conveying passage 131 and the receiving room 213 maintains being closed and the cooling medium 15 is prevented from leakage.

Figure 5:
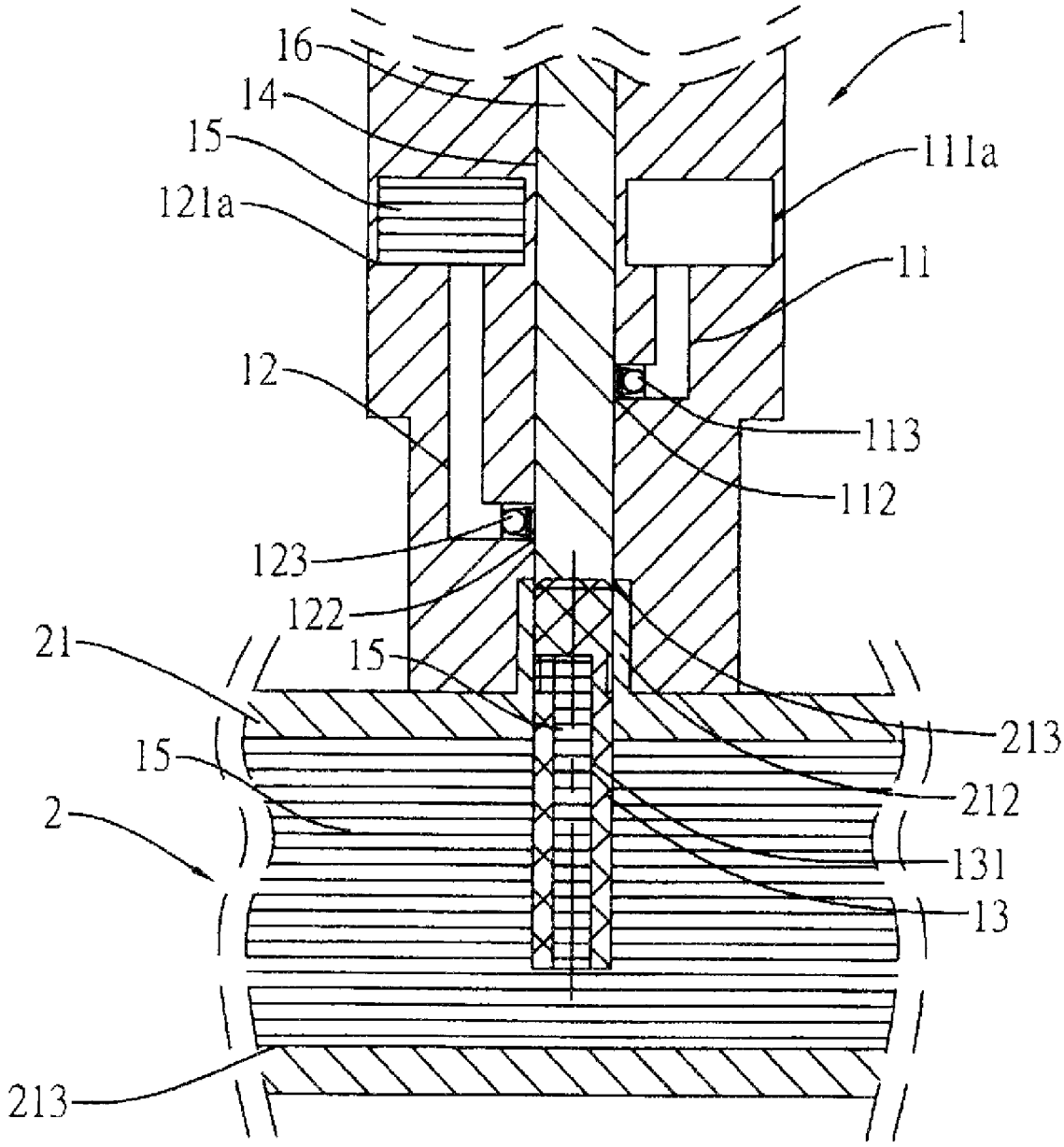
FIG. 5 is a sectional view similar to FIG. 4 illustrating the device of present invention being in a state of sealing the cooling medium.

FIG. 5 illustrates the device 1 is in a state of sealing the work piece 2. The sealing component 13 is inserted into the work piece 2 to seal the work piece 2.

Figure 6:
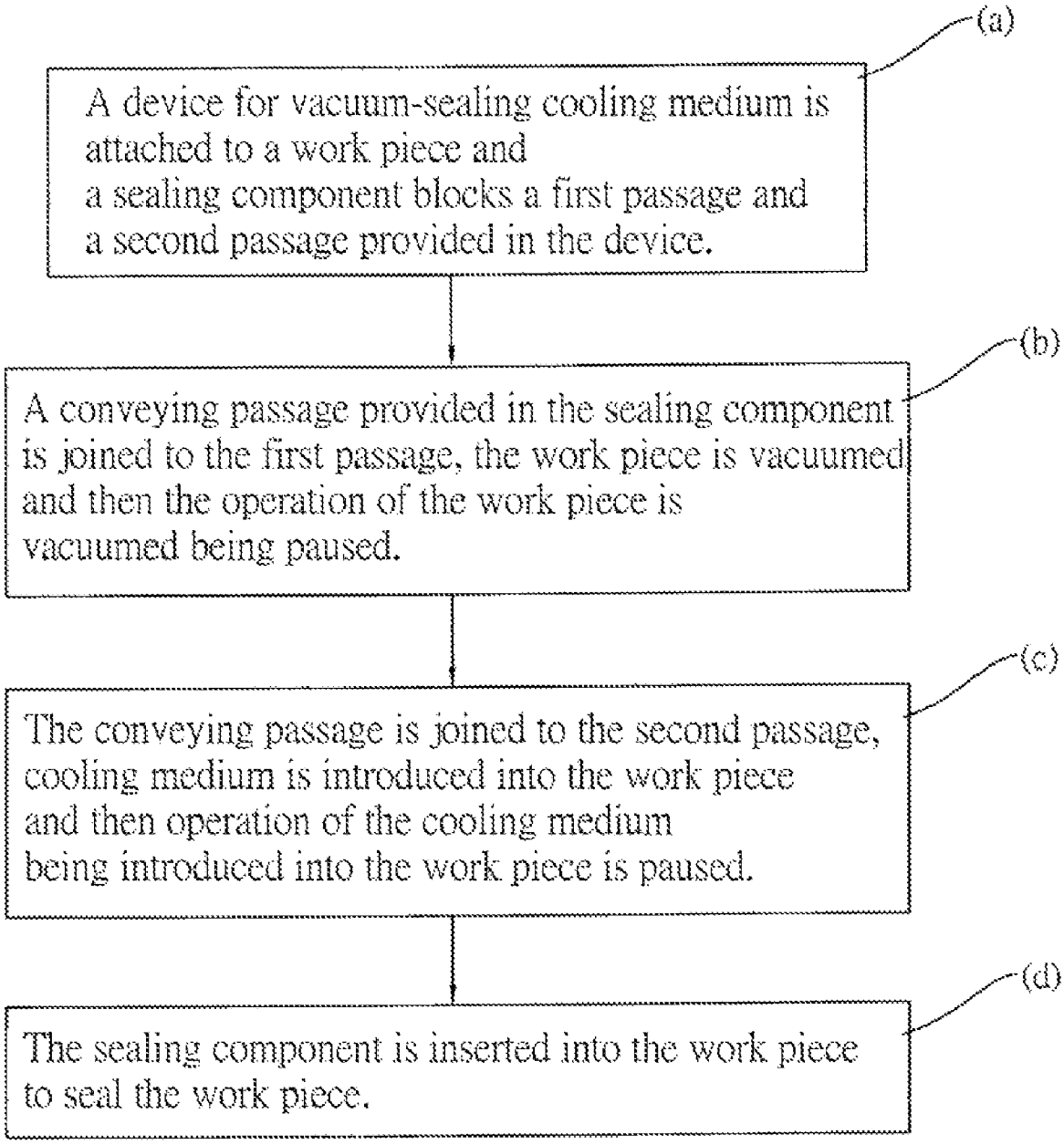
FIG. 6 is a flow chart of a method for vacuum-sealing a cooling medium according to the present invention corresponding to the first embodiment of the device illustrated in FIG. 1.

Referring to FIG. 6, the method for vacuum-sealing a cooling medium performed by the preceding first embodiment of the present invention can be summarized with the following steps: (a) the device being attached to the work piece and the sealing component blocking the first and second passages; (b) the conveying passage of the sealing component being joined to the first passage and the work piece being vacuumed; (c) the conveying passage being joined to the second passage and the cooling medium being introduced into the work piece and pausing the operation of introducing the cooling medium; and (d) the sealing component being inserted into the work piece to seal the work piece.

Figure 7:
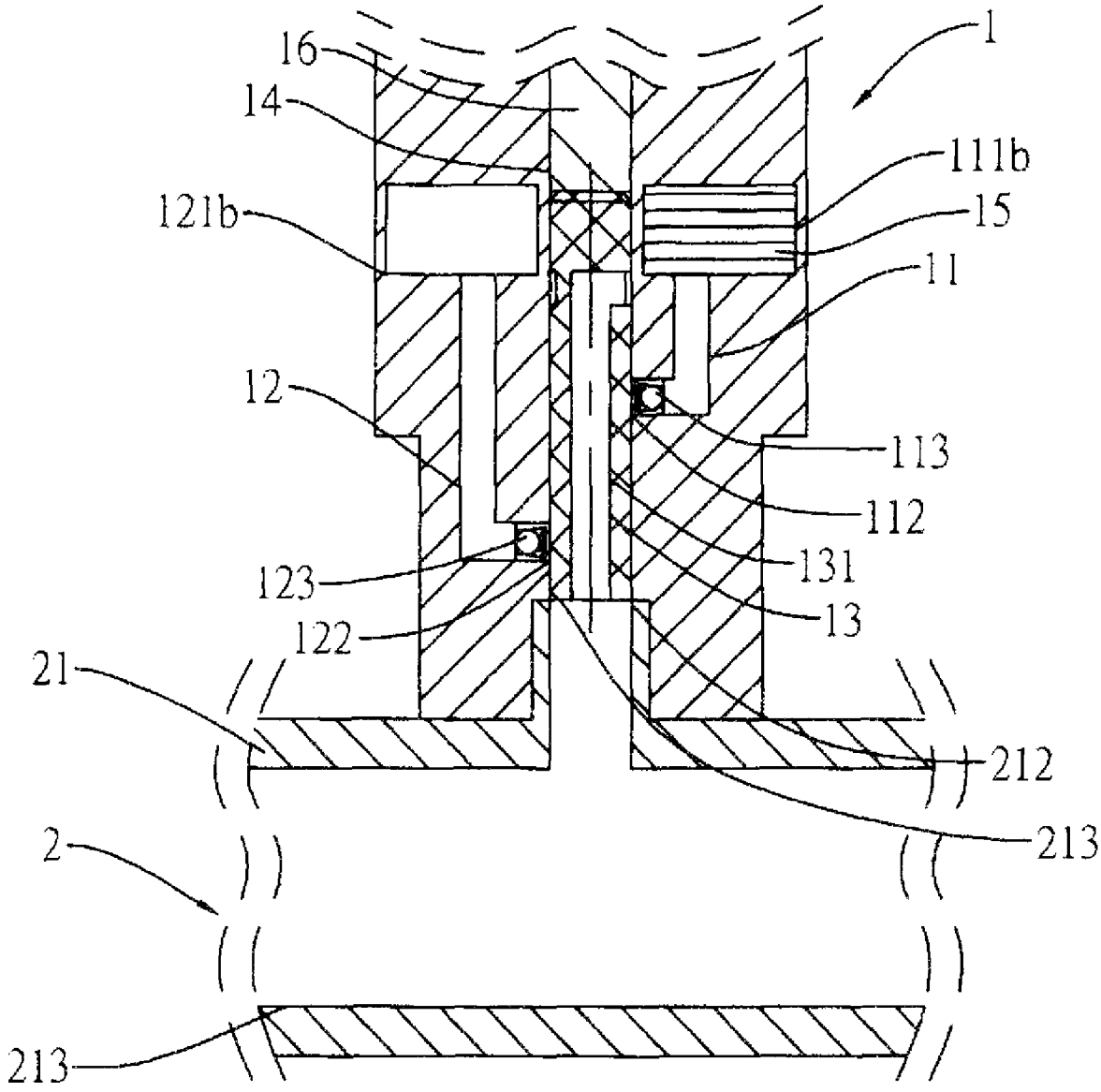
FIG. 7 is a sectional view of the second preferred embodiment of a device capable of vacuum-sealing a cooling medium according to the present invention illustrating the sealing member being disposed at a position in the sealing passage ready for working.

Referring to FIG. 7, the second embodiment of the present invention is illustrated. The difference of the second embodiment from the first embodiment is in that an end of the first passage 11 is attached to the cooling medium supply unit 111*b* and the second passage 12 is attached to the sucking unit 121*b*.

Figure 8:
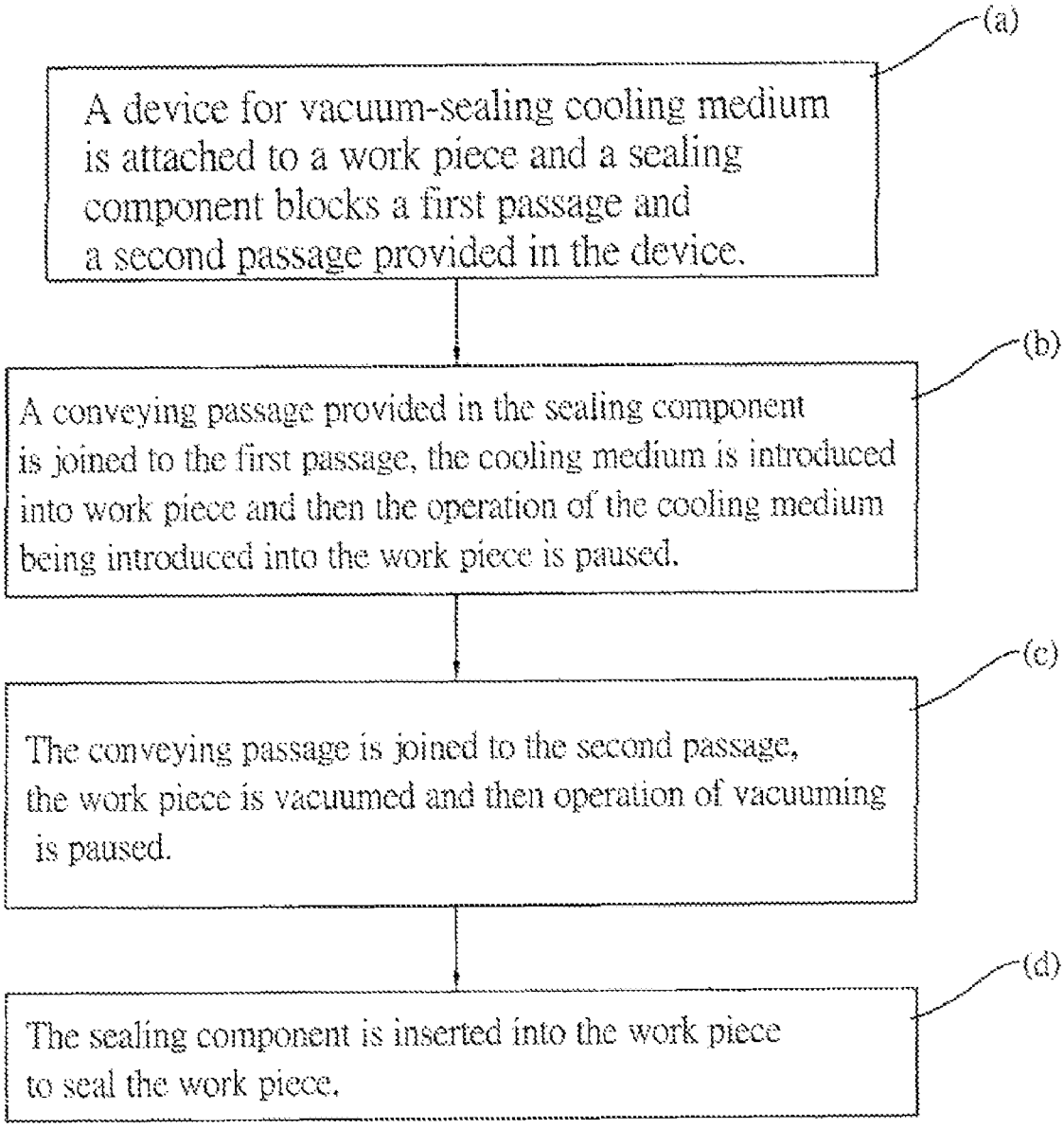
FIG. 8 is a flow chart of a method for vacuum-sealing a cooling medium according to the present invention corresponding to the second embodiment of the device illustrated in FIG. 7.

Referring to FIG. 8, the method for vacuum-sealing a cooling medium performed by the preceding second embodiment of the present invention can be summarized with the following steps: (a) the device being attached to the work piece and the sealing component blocking the first and second passages; (b) the conveying passage of the sealing component being joined to the first passage, the cooling medium being introduced into the work piece and then pausing the operation of introducing the cooling medium into the work piece; (c) the conveying passage being joined to the second passage and vacuuming the work piece and then pausing the operation of vacuuming; and (d) the sealing component being inserted into the work piece to seal the work piece.

It is appreciated that a device and a method for vacuum-sealing cooling medium according to the invention has the following advantages:

(1) The criteria for building structure for fabrication the work piece, design for the work piece and operational technique are significantly lowered such that cost related to making the work piece and personnel are reduced greatly.

(2) The device of the present invention can be processed automatically to attain purpose of mass production.

(3) The sealing component with a conveying passage is provided purely for vacuuming the receiving room or introducing the cooling medium and can be inserted into the work piece for sealing the work piece.

While the invention has been described with referencing to preferred embodiments thereof, it is to be understood that modifications or variations may be easily made without departing from the spirit of this invention, which is defined by the appended claims.

What is claimed is:

1. A device for vacuum-sealing cooling medium capable of allowing a work piece being vacuumed and a cooling medium being introduced into the work piece comprising:

a first passage with a first end and a second end;

a second passage with a third end and a fourth end;

a sucking unit being connected to said first end;

a cooling medium supply unit being joined to said third end; and a sealing passage communicating with said second and fourth ends respectively and providing a sealing component, wherein a conveying passage is provided at the sealing component for the work piece being vacuumed via said first passage and the cooling medium being introduced into the work piece via said second passage.

2. The device for vacuum-sealing cooling medium as defined in claim 1, wherein a check valve is disposed in said first passage and said second passage.

3. The device for vacuum-sealing cooling medium as defined in claim 1, wherein said cooling medium is liquid or gas.

4. The device for vacuum-sealing cooling medium as defined in claim 1, wherein a driving unit is provided to press against the sealing component.

5. A method for vacuum-sealing cooling medium comprising following steps:

(a) a device for vacuum-sealing cooling medium being attached to a work piece and a sealing component blocking a first passage and a second passage provided in said device;

(b) a conveying passage provided in said sealing component being joined to the said first passage, the work piece being vacuumed and the operation of the work piece being vacuumed being paused;

(C) said conveying passage being joined to said second passage, cooling medium being introduced into said work piece and then operation of the cooling medium being introducing into said work piece being paused; and (d) said sealing component being inserted into the work piece to seal the work piece.

6. The method for vacuum-sealing cooling medium as defined in claim 5, wherein a step in which said cooling medium is introduced into said work piece and then the operation of said cooling medium being introduced into said work piece being paused after said conveying passage being joined to said passage is employed instead of step (b) and a further step in which said work piece is vacuumed and then the operation of vacuum is paused is employed instead of step (c).

* * * * *